United States Patent [19]

Hayashi

[11] 4,369,831

[45] Jan. 25, 1983

[54] PROTECTOR FOR MOLTEN METAL CASTING STREAM

[75] Inventor: Kyozo Hayashi, Osaka, Japan

[73] Assignee: Sumitomo Electric Industries, Ltd., Osaka, Japan

[21] Appl. No.: 99,029

[22] Filed: Nov. 30, 1979

Related U.S. Application Data

[63] Continuation of Ser. No. 804,170, Jun. 6, 1977, abandoned.

[30] Foreign Application Priority Data

Jun. 10, 1976 [JP] Japan ..... 51-76274

[51] Int. Cl.[3] ..... B22D 11/10

[52] U.S. Cl. ..... 164/415; 164/416; 164/437

[58] Field of Search ..... 164/416, 415, 259, 437; 222/600, 603; 362/418, 419, 430

[56] References Cited

U.S. PATENT DOCUMENTS

| | | | |
|---|---|---|---|
| 1,879,076 | 9/1932 | Carle | 164/337 |
| 3,482,621 | 12/1969 | Halliday | 164/415 X |
| 3,563,938 | 2/1971 | Gallucci et al. | 222/600 X |
| 3,616,843 | 11/1971 | Newhall et al. | 164/259 X |
| 3,730,401 | 5/1973 | Bode, Jr. | 164/437 X |
| 3,749,387 | 7/1973 | Andrzejak et al. | 164/439 X |
| 3,756,305 | 9/1973 | Haussner | 164/415 X |
| 3,840,062 | 10/1974 | Kenney | 164/82 X |

FOREIGN PATENT DOCUMENTS

| | | | |
|---|---|---|---|
| 768317 | 12/1971 | Belgium | 164/415 |

*Primary Examiner*—R. L. Spruill
*Assistant Examiner*—J. Reed Batten, Jr.
*Attorney, Agent, or Firm*—Wenderoth, Lind & Ponack

[57] ABSTRACT

A protector for a molten metal casting stream includes first and second pipes telescopically connected to each other to form a pipe assembly, and an urging means mounted about the pipe assembly so as to force it to extend in the lengthwise direction.

2 Claims, 2 Drawing Figures

PROTECTOR FOR MOLTEN METAL CASTING STREAM

This is a continuation of application Ser. No. 804,170, filed June 6, 1977, now abandoned.

BACKGROUND AND SUMMARY OF THE INVENTION

The present invention relates to a protector for a molten metal casting stream.

In a continuous casting operation, as shown in FIG. 1, molten metal A supplied from a ladle 10 to a tundish 20 is poured into a continuously vibrated mold 30 to produce a steel strand C. During casting, if a casting stream B is exposed to the air, the molten metal is oxidized, thus causing surface defects and non-metallic inclusion in the cast strand C.

In order to protect the casting stream from oxidation by the air and to improve the quality of the continuously cast strand, there have been proposed various methods and devices, for example, a so-called nozzle submerging method, a gas curtain method and a bellows protecting method.

In the nozzle submerging method, a refractory nozzle for pouring the molten metal is submerged below the meniscus of molten metal in the mold. This is highly effective for preventing oxidation. However, in the continuous casting of a billet having a relatively small cross section, the refractory nozzle easily adheres to the wall of the mold, and this method is thus not practicable, with the exception of the continuous casting of a bloom or a slab.

The second method in which an inert gas curtain is formed around the casting stream is the best in operation, but wastes a great deal of gas, thus resulting in higher cost. Moreover, it is difficult to reduce the oxygen in the atmosphere to less than 1%. Optimum conditions for preventing the casting stream from oxidation is to have the oxygen present be less than 0.1 to 0.4%. Therefore, this method is less effective.

In the third method, a bellows is used for enclosing the casting stream, and an inert gas is supplied into the bellows. This method makes it possible to form an effective non-oxidation atmosphere by supplying sufficient inert gas. However, the bellows, even if made of asbestos, is soon weakened by the radiation of heat from the casting stream. In order to reduce the influence of heat, the diameter of the bellows may be made larger, thus allowing greater capacity for breathing during vibration of the mold which causes alternate expansion and contraction of the bellows. In order to avoid the suction of air, a great deal of gas is needed. Moreover, when an accident requires interruption or stoppage of casting, an emergency runner cannot be used owing to the obstruction created by the bellows being fixed to the bottom wall of the tundish. Therefore, a permanent tundish gate stopper is indispensable, thus resulting in disadvantages in operation as well as in the cost for refractory material. Further, the casting stream and the meniscus of the molded metal cannot be watched since the bellows obstructs the view. Therefore, a permanent level controller for the meniscus of the molded metal is indispensable.

An object of the present invention is to obviate the various defects in the conventional protecting methods and devices, and to provide a casting stream protector which enables reduction of gas consumption, easy mounting and dismounting, improvement of operation, and production of a cast strand having higher quality with few deficiencies.

BRIEF DESCRIPTION OF THE DRAWINGS

Other objects and features of the present invention will be apparent from the following description of the invention with reference to the accompanying drawings, in which.

DETAILED DESCRIPTION OF THE INVENTION

Figure 1:
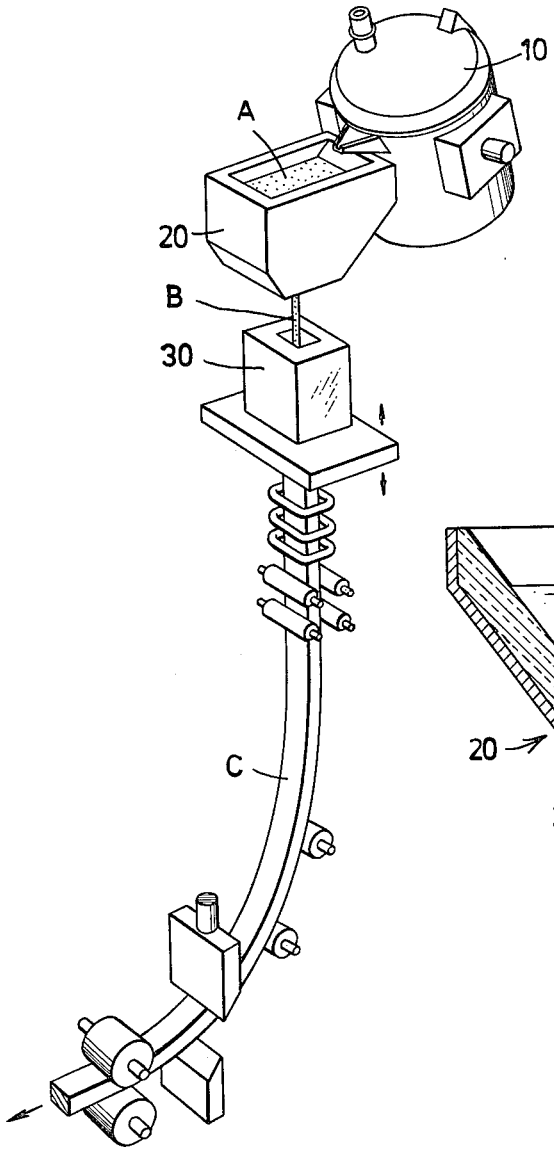
PRIOR ART FIG.1
FIG. 1 is a perspective view illustrating a continuous casting apparatus for explanation of the status of the art.
Figure 2:
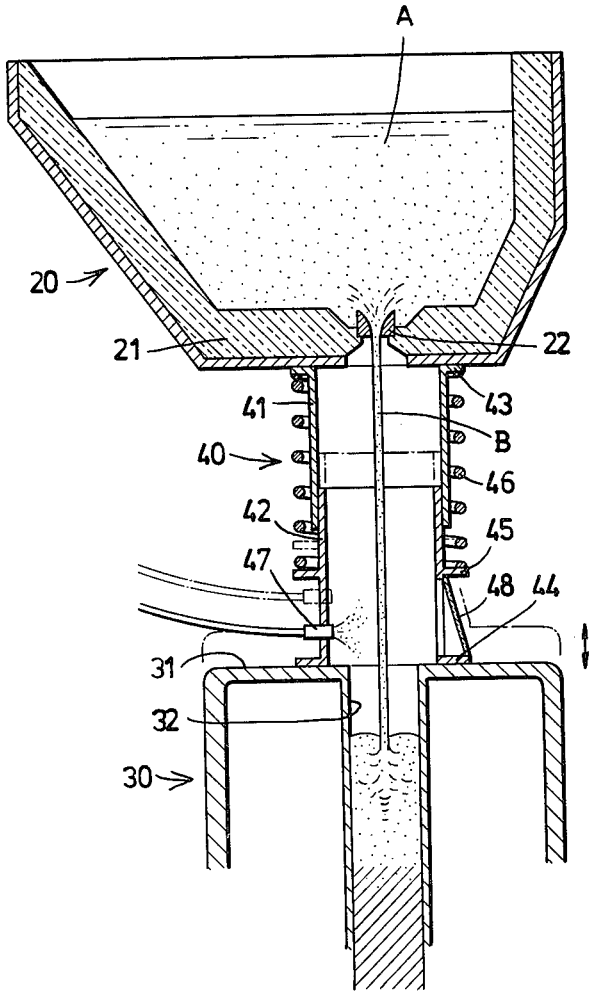
FIG. 2 is a vertically sectioned view of the main part of the casting apparatus incorporating a casting stream protector according to the present invention.

Referring now to FIG. 2, the known tundish 20 contains molten metal A supplied from the ladle 10 or furnace (not shown). In a bottom wall 21 of the tundish 20 is provided a pouring gate 22 through which the molten metal pours in the form of casting stream B into the mold 30. The mold 30 is continuously vibrated during casting.

Between the bottom wall 21 of the tundish 20 and an upper face 31 of the mold 30 is mounted a casting stream protector 40 extending around the casting stream B. The protector 40 comprises a first pipe 41 made of iron or steel and a second pipe 42 made of iron or steel. It is to be noted that the inside cross sectional area of the second pipe 42 is substantially the same as that of a hole 32 of the mold 30.

The first and second pipes 41, 42 are telescopically connected to each other so that the outer periphery of the upper portion of the second pipe 42 slidably and almost air-tightly fits into the inner periphery of the lower portion of the first pipe 41.

The first pipe 41 has about its upper end a flange 43 abutting the outer face of the bottom wall 21 of the tundish 20. The second pipe 42 has about its lower end a flange 44 abutting the upper face 31 of the mold 30 and about its middle portion a collar 45.

Between the flange 43 and collar 45 an urging means 46 such as a coil spring is mounted about the pipe assembly so as to force it to extend in the lengthwise direction. Thus, the flange 43 and flange 44 tightly engage the lower face of the tundish 20 and the upper face of the mold 30, respectively. In the drawings, a coil spring is used as the urging means 46. However, there may be employed any other means which urge the pipe assembly to extend. In this manner, the urging means 46 permits the pipe assembly to resiliently extend and contract so that it can follow the variation of the space between the tundish 20 and mold 30 which results from the vertical vibration of the latter.

In the manner mentioned above, about the casting stream B is formed a sealing channel structure, which however is not completely air-tight.

In the lower non-sliding portion of the second pipe 42 is provided a supply inlet 47 for supplying a suitable amount of inert or reducing gas into the inside of the pipe assembly. Further, in the non-sliding portion is provided an opening covered with heat resisting glass 48 for watching the casting operation.

According to the present invention as described above, since the inside cross sectional area of the second pipe 42 is adapted to be substantially the same as that of the hole 32 of the mold 30, the total inside capacity of the pipe assembly and space of hole 32 remains almost constant despite the variation of length of the pipe assembly resulting from the vibration of mold 30. Therefore, there occurs no breathing of air between the inside and outside of the pipe assembly, unlike a conventional bellows, with the result that the supply of gas can be greatly reduced. Further, the non-oxidation and reducing atmosphere can be effectively maintained since the smaller amount of inert gas supplied does not dilute the reducing atmosphere such as hydrocarbon or hydrogen which is generated adjacent the casting stream and the meniscus of the molded metal by the heat resolution of mold lubricant when it touches the molten metal in the inert gas.

The gas to be supplied may be either an inert gas such as nitrogen and argon gas or a reducing gas such as ammonia resolution gas, hydrogen gas and reformed gas. However, because of the above second advantage that the naturally produced reducing gas will not be diluted, a particular supply of reducing gas will not necessarily be required. The inert gas alone is sufficient and the consumption thereof can be minimized.

Moreover, the fact that the reducing gas generated by the above process is not diluted with the inert gas supplied brings further great advantages. That is, the reducing gas forced out of the clearance of the protector reaches the inflammable density, thereby producing a constant, stable flame. However, more the inert gas supplied, the more diluted the reducing gas becomes. As a result, the flame goes out, and cannot be fired. At the same time, hydrocarbon is generated to cause smoke and unpleasant odors. That is not only uncomfortable to the operator but also is harmful to the health of the operator. According to the present invention, however, the above defects are completely eliminated since the reducing gas is only slightly diluted.

The protector of the invention may be made of iron or steel. Therefore, it has a greater fire-proofness and heat resistance. As a result, there will be no need for increasing the size of the pipe assembly, and a smaller amount of supplied gas can effectively prevent the oxidation of the casting stream, thereby enabling economical production of a cast strand having better quality without any surface defects and non-metallic inclusions.

Still further, since the protector of the invention is fixed neither to the tundish nor to the mold, but is detachably engaged therewith by the urging means, it can readily be mounted or dismounted. Therefore, when it is desired to interrupt or stop casting, the protector can be speedily removed to permit the use an emergency runner. There will be no need to incorporate a tundish gate stopper such as in the conventional bellows protecting method or nozzle submerging method. Therefore, the protector of the invention provides excellent efficiency in operation as well as cost.

What is claimed is:

1. In an apparatus for continuously casting a metal strand, said apparatus including a tundish having a bottom wall with a fixedly positioned and immovable gate therein, a vertically vibrating casting mold positioned beneath said tundish, said mold having an upper wall and a mold hole extending through said upper wall into said mold, and a protective device positioned between said gate of said tundish and said mold hole for protecting a flow of molten metal therebetween, the improvement wherein said protective device is a pipe assembly comprising:

a hollow first pipe having first and second ends, said first end having therearound a first flange, said first pipe being positioned with said first flange surrounding said gate of said tundish and being in direct contact with but unattached to said bottom wall of said tundish;

a hollow second pipe having first and second ends, said first end of said second pipe being telescopically fitted into said second end of said first pipe, said second end of said second pipe having therearound a second flange, said second pipe being positioned with said second flange surrounding said mold hole and being in direct contact with but unattached to said upper wall of said mold;

urging means, contacting said first flange and a portion of said second pipe, for urging said first and second pipes telescopically away from each other and for forcing said first and second flanges into direct contact with said bottom wall of said tundish and said upper wall of said mold, respectively, and for thereby forming an air-tight seal between said pipe assembly and said tundish and said mold, and for removably and unattachably holding said pipe assembly between said tundish and said mold;

said entire pipe assembly being free of connection or attachment of any type to either said tundish or said mold; and said second pipe having an inner cross-sectional area, throughout the entire length thereof, substantially equal to the cross-sectional area of said mold hole.

2. The improvement claimed in claim 1, further comprising gas supply inlet means extending into said pipe assembly for supplying therein a gas, and view means in one of said first and second pipes for allowing viewing into said pipe assembly.

* * * * *